United States Patent [19]

Grieben et al.

[11] 4,449,625

[45] May 22, 1984

[54] APPARATUS FOR TRANSPORTING TRAYS FOR CIGARETTES OR THE LIKE

[75] Inventors: Karl H. Grieben, Schwarzenbek; Günter Menge, Hamburg, both of Fed. Rep. of Germany

[73] Assignee: Hauni-Werke Körber & Co. KG., Hamburg, Fed. Rep. of Germany

[21] Appl. No.: 304,266

[22] Filed: Sep. 21, 1981

[30] Foreign Application Priority Data

Oct. 1, 1980 [DE] Fed. Rep. of Germany ..... 3037065

[51] Int. Cl.[3] ..... B65G 37/00

[52] U.S. Cl. ..... 198/472; 198/478

[58] Field of Search ..... 198/472, 478, 797, 486, 198/689; 414/419, 420, 421, 735, 744 R, 744 A, 744 B, 744 C, 749, 754, 776

[56] References Cited

U.S. PATENT DOCUMENTS

| | | | |
|---|---|---|---|
| 3,567,011 | 3/1971 | Pinkham | 198/478 |
| 3,952,865 | 4/1976 | Rudszinat et al. | 198/689 |
| 3,992,855 | 11/1976 | Palmieri et al. | 198/797 |

*Primary Examiner*—Joseph E. Valenza
*Assistant Examiner*—Jonathan D. Holmes
*Attorney, Agent, or Firm*—Peter K. Kontler

[57] ABSTRACT

Apparatus for transporting holders for filled cigarette trays from the lower level of a tray filling machine to the higher level of a removing station defines an elliptical path at the vertex of which filled trays are removed from the holders and at the lowermost point of which empty holders receive trays which are filled with arrays of cigarettes. The holders are transported by conveyors which are directly or indirectly mounted on levers rotating about axes which are defined by the arms of a further lever rotating about a fixed axis. The holders are guided in such a way that their orientation remains unchanged during transport along the elliptical path.

33 Claims, 7 Drawing Figures

53
52
48
49
48a
47
19
H
50
36
41
54
54a
56
23
27
39
32
37a
38
60
29
51
55
29a
29b
42
28
46
60
51
55
37
37a
38
26
41
53
52
54a
54
48
49
48a
50
39
33
47
31
22
17
17a

APPARATUS FOR TRANSPORTING TRAYS FOR CIGARETTES OR THE LIKE

BACKGROUND OF THE INVENTION

The present invention relates to apparatus for transporting receptacles in the form of chargers or trays between spaced-apart first and second stations, and more particularly to improvements in apparatus for transporting chargers or trays of the type customarily employed for temporary storage and transport of cigarettes, filter rod sections or analogous rod-shaped articles which constitute or form part of smokers' products. Still more particularly, the invention relates to improvements in apparatus for transporting holders which removably receive filled or empty chargers or trays for cigarettes, filter rod sections or the like.

It is well known to employ chargers or trays (hereinafter called trays) for temporary storage and transport of stacks or arrays of parallel cigarettes or analogous rod-shaped articles which constitute or form part of smokers' products. As a rule, trays are filled with rod-shaped articles (hereinafter referred to as cigarettes with the understanding, however, that the trays can be filled with other types of rod-shaped articles which constitute or form part of smokers' products) during stepwise descent along the discharge end of a cigarette making or analogous machine. Reference may be had to U.S. Pat. No. 3,519,143 granted July 7, 1970 to Kochalski et al. This patent (which is incorporated herein by reference) discloses that the cigarettes can be accumulated into horizontal rows, and successive rows are thereupon introduced into the adjacent tray before the tray descends by a step so as to provide room for admission of the next row. The row-forming mechanism and/or the tray can be moved sideways (back-and-forth) during the intervals between transfers of successive rows of cigarettes into the tray so as to ensure that the cigarettes in the adjacent (superimposed) rows are staggered with reference to each other, namely, that the cigarettes which fill the tray are arranged in a so-called quincunx formation. A supply of empty trays is maintained in position of readiness at a level above the tray filling station, and the filled trays are thereupon moved to a higher level, preferably lifted to the level of the supply of empty trays, in order to introduce filled trays into an oncoming gondola of a system of circulating gondolas or analogous conveyors for transport to any one of a plurality of consuming or processing machines which are adjacent to the endless path along which the gondolas travel. The apparatus which moves filled trays from the level to which a freshly filled tray descends during downward movement along the tray filling station to the level of the supply of empty trays is desirable and advantageous because it saves to the attendant or attendants the tiresome task of lifting filled trays from a lower level to a higher level. Instead of delivering filled trays to selected processing or consuming machines, the system of gondolas can also serve for temporary or even long-lasting storage of filled trays, for example, when the processing machine or machines are out of commission while the cigarette making machine continues to turn out large quantities of cigarettes. A modern high-speed cigarette maker is capable of turning out in excess of 6,000 cigarettes per minute.

Certain heretofore known transporting apparatus which are utilized to lift filled trays from a lower level to a higher level are designed to define a single path along which a holder for trays can move upwardly to thereby deliver a filled tray to the level of the gondolas and thereupon downwardly so as to return to a position for reception of the next filled tray. Such single-path apparatus with reciprocating holder means for filled trays are incapable of handling the output of a modern tray filling machine. This is attributable to the fact that the empty holder must perform a return stroke prior to reaching a position in which it can accept the next filled tray for transport to the higher level. The time which elapses during downward movement of the unoccupied holder constitutes one-half of the total period of operation of such transporting apparatus.

In accordance with a further proposal, the apparatus for transporting trays between two different levels comprises a chain conveyor which can transport holders for empty and filled trays along an endless path. Thus, while a first holder moves a filled tray from the lower level to the higher level, a second holder which has been relieved of a filled tray can simultaneously descend from the upper level to the lower level so as to assume an optimum position for reception of the next-following filled tray. A drawback of such transporting apparatus is their complexity and high maintenance cost. This is attributable to the need for a substantial number of guide means, for means which maintain the reaches of the endless chain in parallel paths and for switchover devices. Another drawback of such apparatus is extensive wear upon their moving and adjacent stationary parts with attendant frequent and complex maintenance and repair work, and the generation of pronounced noise which is bothersome to the attendants so that the attendants must take frequent breaks.

OBJECTS AND SUMMARY OF THE INVENTION

An object of the invention is to provide a transporting apparatus for filled trays or analogous receptacles which is simple, more rugged, more compact and less prone to malfunction than heretofore known transporting apparatus.

Another object of the invention is to provide a compact and reliable transporting apparatus which generates a minimum of noise so that it can be serviced by attendants for long periods of time without the need for frequent or even infrequent breaks.

A further object of the invention is to provide a transporting apparatus of the above outlined character whose output at least matches the output of the fastest heretofore known transporting apparatus for trays or the like.

Still another object of the invention is to provide the transporting apparatus with novel and improved controls which automatically initiate the transfer of filled trays into oncoming holders as well as the transport of freshly filled holders to the level where such holders are relieved of filled trays.

A further object of the invention is to provide novel and improved drive means and orientation-controlling means for the holders in an apparatus of the above outlined characteristics.

An additional object of the invention is to provide the transporting apparatus with novel and improved means for preventing changes in orientation of holders which support and lift filled trays for cigarettes or the like.

A further object of the invention is to provide the above-outlined apparatus with novel and improved means for reducing the likelihood of changes in relative positions of articles which are stored in the trays during transport from a lower level to a higher level.

An ancillary object of the invention is to provide the apparatus with novel and improved means for smoothly decelerating and/or accelerating holders which transport filled trays from a first level to a different second level.

A further object of the invention is to provide an apparatus which can be installed in or associated with existing tray filling machines and occupies only a minute fraction of space that is required in such machines to accommodate conventional transporting apparatus.

The invention is embodied in an apparatus for transporting trays, chargers or analogous containers for cigarettes, filter rod sections or other rod-shaped articles which constitute or form part of smokers' products from a first station to a second station, particularly for transporting filled chargers or trays from a first (tray filling) station which is disposed at a first level to a second (removing or receiving) station at a second or higher level. The apparatus comprises first drive means (e.g., a lever which is rotatable about a fixed axis) having a portion (e.g., a bearing sleeve which is remote from the fixed axis) which rotates along a first circular path, second drive means (such second means can comprise a second lever) mounted in or on the portion of the first drive means and having a portion (e.g., a bearing sleeve remote from the bearing sleeve of the lever forming part of the first drive means) which is arranged to orbit along a second circular path superimposed upon the first circular path, and conveyor means for containers. The conveyor means is rotatably mounted on the aforementioned portion of the second drive means and preferably comprises holder means for removably or detachably supporting a container during travel of such holder means from the first to the second station. The holder means defines an endless path (preferably a narrow elliptical path) having a vertex at the second station.

The apparatus preferably further comprises means (e.g., an electric motor and a belt transmission) for orbiting the aforementioned portion of the first drive means along the first circular path and means (such as a gear on a shaft for the second drive means and an endless belt receiving motion from or in response to rotation of the first drive means) for orbiting the aforementioned portion of the second drive means along the second circular path in or counter to the direction of orbital movement of the portion of the first drive means. Still further, the apparatus preferably comprises means for transmitting motion from one of the drive means to the other drive means; such motion transmitting means can constitute or include a component part of the means for orbiting the aforementioned portion of the second drive means along the second circular path.

The apparatus can further comprise third drive means which is interposed between the second drive means and the conveyor means and serves to prevent changes in orientation of the holder means during orbital movements of the aforementioned portions of the first and second drive means along the respective circular paths. Such apparatus preferably further comprises intermediate drive means which is operatively connected with the first and second drive means and serves to transmit motion to the third drive means.

The first and second drive means can be disposed in a predetermined plane or in two parallel planes, and the apparatus can further comprise means (e.g., a face cam and a roller follower which tracks the cam) for rotating the holder means with reference to the third drive means about an axis which is normal to the aforementioned plane or planes. This ensures that the holder means delivers a container to the second station in an optimum orientation for removal or other treatment. The just mentioned rotating means is preferably superimposed upon the second and third drive means.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
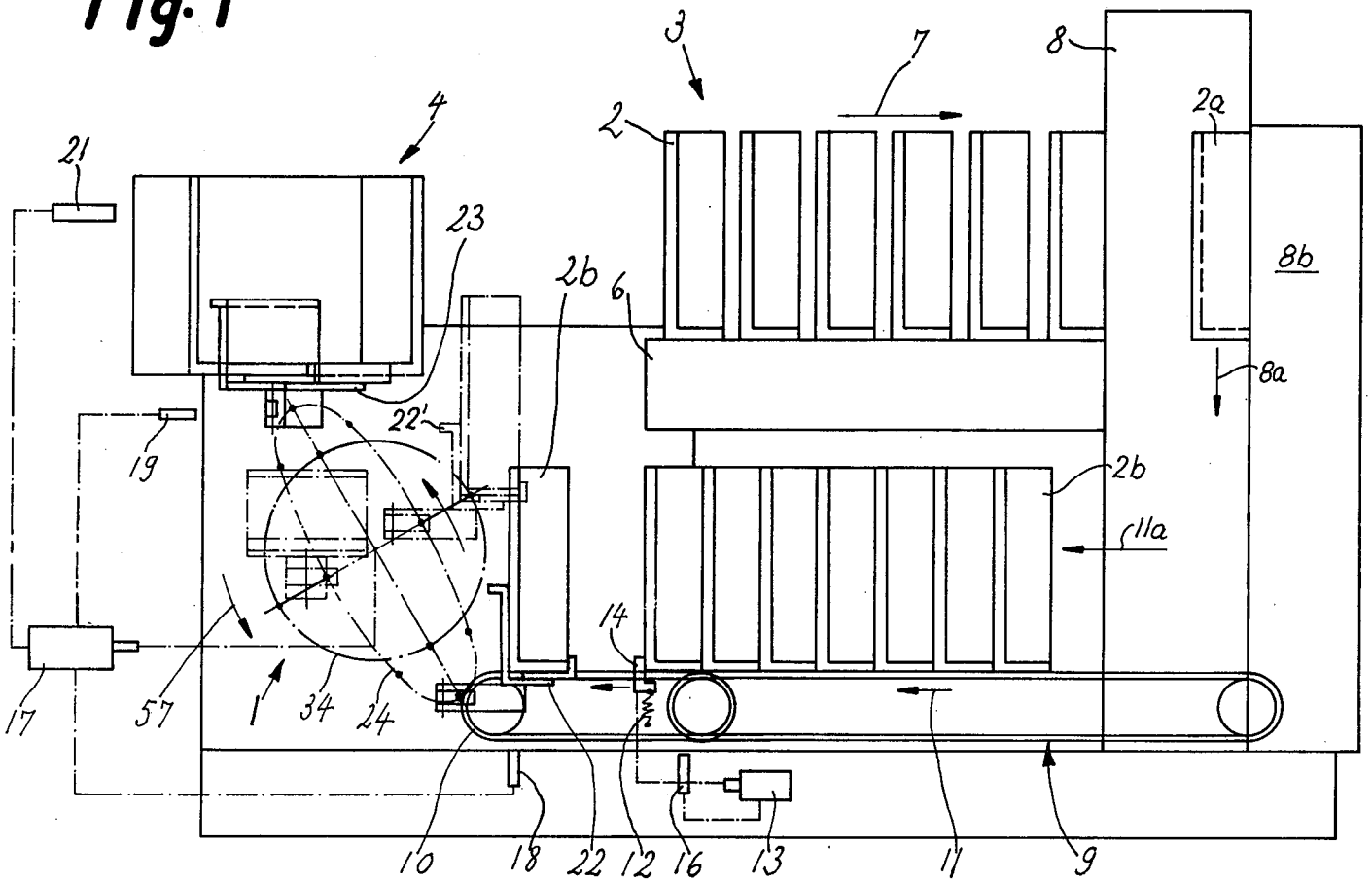
FIG. 1 is a schematic elevational view of a tray filling machine and of a transporting apparatus which embodies one form of the invention.
Figure 2:
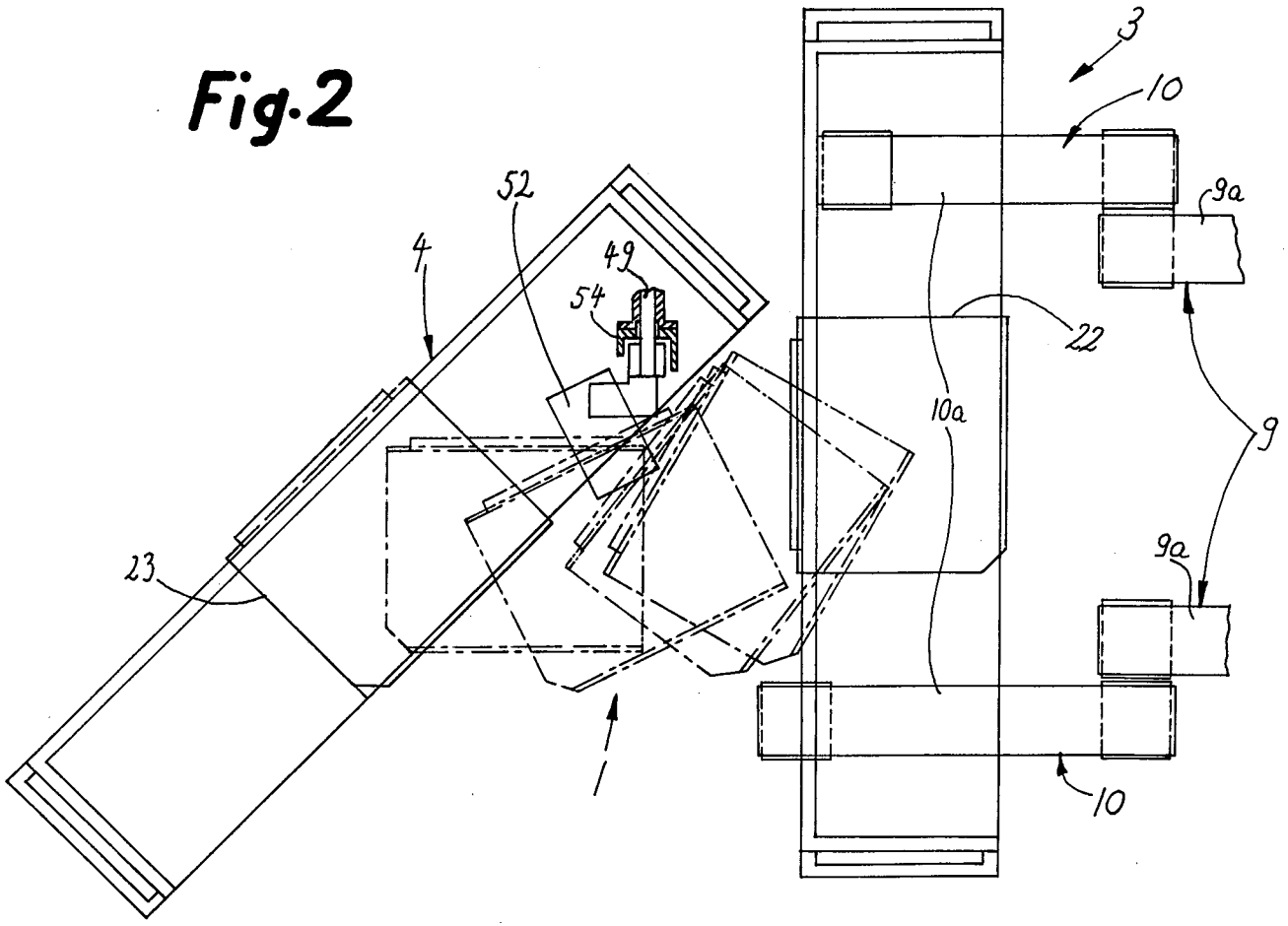
FIG. 2 is a plan view of a portion of the tray filling machine and of the apparatus which embodies the invention and serves to transport filled trays from a lower level to a higher level.

Referring first to FIGS. 1 and 2 there is shown a tray filling machine which serves to introduce stacks of properly arrayed rod-shaped articles (hereinafter referred to as cigarettes) into successive empty chargers or trays 2 (hereinafter called trays). The machine comprises a first conveyor 6 which is arranged to transport a succession of empty trays 2 in the direction indicated by arrow 7, namely, at a tray filling station 3 which further accommodates a vertical conveyor 8 serving to lower successive empty and partially filled trays in stepwise fashion along a vertical path which is indicated by the arrow **8*a*. A tray 2*a* which is in the process of being filled during transport by the conveyor 8 advances past a row forming device 8*b* which may be of the type disclosed in the aforementioned U.S. Pat. No. 3,519,143 to Kochalski et al. Successive filled trays 2*b* are deposited on the upper reach of an endless belt of chain conveyor 9 whose upper reaches advance in the direction of arrow 11 and thereby transport such filled trays in the direction away from the row forming device 8*b*. The filled trays 2*b* form a row of abutting trays and are advanced stepwise in the direction indicated by arrow 11*a***.

The machine which is shown in FIGS. 1 and 2 further comprises a removing or receiving station 4 for filled trays **2*b*. This station is located at or close to the level of the supply of empty trays 2 on the conveyor 6. The purpose of the improved transporting apparatus which is denoted by the reference character 1 is to transport successive filled trays 2b from the discharge end of the conveyor 9 to the removing station 4 so that an attendant who is in charge of accepting and manipulating filled trays 2b at the station 4 need not perform the tedious and tiresome task of lifting filled trays 2b from the level of the paper reach of the conveyor 9 to the level of the removing station 4. In accordance with a feature of the invention, the transporting apparatus 1 has two tray holders 22, 23 which are caused to advance along a relatively narrow elliptical path 24** indicated by phantom lines.

The tray filling machine of FIGS. 1 and 2 further comprises several detectors and other monitoring, starting, arresting and analogous operation controlling or regulating elements which ensure proper synchronization of movements of various conveyors of the tray filling machine with the movements of holders 22, 23 of the transporting apparatus 1. More particularly, the just mentioned elements serve primarily to synchronize the operation of the conveyor 9 for delivery of filled trays 2b into the range of the holders 22, 23 with the operation of the transfer apparatus 1.

The left-hand portion 10 of the conveyor 9 for filled trays 2b constitutes a separating unit which can be driven at a relatively high speed. The upper reach or reaches (see FIG. 2) of its belts 10a can be driven at a speed which is higher than the speed of the rear belt or belts 9a of the conveyor 9. The purpose of the faster belts 10a is to separate the foremost filled tray 2b from the next-following filled trays 2b so as to ensure that the thus segregated foremost filled tray 2b can be readily introduced into or placed onto the adjacent empty holder 22 or 23 without any interference on the part of filled trays 2b therebehind. The means for temporarily intercepting or arresting the row of filled trays 2b on the belts 9a of the conveyor 9 comprises one or more pivotable pawls 14 adjacent to the upper reaches of the belts 10a of the separating unit or portion 10 and pivotable into and from the path of oncoming filled trays 2b on the belts 9a. A tension spring 12 is provided to urge the arresting pawl 14 to its inoperative position, namely, to pivot the pawl in a counterclockwise direction, as viewed in FIG. 1. The pawl 14 can be provided clockwise to the operative position shown in FIG. 1 by the armature of an electromagnet 13 which is energizable by a monitoring device, for example, a proximity detector or initiator 16 shown in the lower portion of FIG. 1. The monitoring device 16 generates a signal in response to detection of the foremost one of the row of abutting filled trays 2b on the belts 9a of the conveyor 9.

The means for transmitting torque or other motion to component parts of the transporting apparatus 1 comprises a prime mover here shown as a rotary electromagnet 17 which is associated with a suitable brake and can receive signals from a monitoring device or detector 18 adjacent to the separating portion or unit 10 of the conveyor 9, from a second monitoring device or detector 19 which is adjacent to the vertex of the eliptical path 24 defined by the conveyor system of the transporting apparatus 1 and a monitoring device in the form of a photocell 21 which is adjacent to the removing station 4. Each of the monitoring devices 18 and 19 may constitute a proximity detector or initiator which is analogous to or identical with the initiator 16.

The separating portion or unit 10 of the conveyor 9 can be said to define a first station which is located at a level below the removing station 4, and the purpose of the apparatus 1 is to transport filled trays 2b from the station which is defined by the unit 10 to the removing station 4 while the holder 22 or 23 is caused to advance from the lower level to the higher level.

It goes without saying that the transporting apparatus which is shown in FIGS. 1 and 2 can be provided with a single holder (22 or 23) or with three or more holders for filled trays 2b. The illustrated transporting apparatus 1 comprises two holders 22 and 23 which are spaced apart from each other in such a way that one thereof is located at the vertex of the elliptical path 24 when the other is located at the lowermost point of such path, and vice versa. The holders 22 and 23 are caused to move in the direction indicated by arrow 57 (namely, in a counterclockwise direction, as viewed in FIG. 1) and an intermediate position of the holder 22 is shown in FIG. 1 by phantom lines, as at 22'. In FIG. 1, the holder 22 is adjacent to the discharge end of the conveyor 9 and already contains or supports a filled tray 2b so that it can move toward and beyond the position 22' in order to lift the filled tray 2b therein to the level of the removing station 4. As mentioned before, the removing station 4 can be located at the level of a system of gondolas or analogous conveyors for temporary or even longer-lasting storage of filled trays 2b as well as for transport of such trays to any one of several processing or consuming machines which can be installed adjacent to the path of movement of gondolas at the level of the removing station 4. The gondolas can also transport filled trays 2b to a machine which pneumatically propels rod-shaped articles to two or more remote processing or consuming machines. Such pneumatic propelling machines are manufactured by the assignee of the present application under the name Filtromat.

When the separating portion or unit 10 of the conveyor 9 has transferred the foremost filled tray 2b into or onto the adjacent holder (note the holder 22 of FIG. 1), the belts 9a of the conveyor 9 transport the entire row of filled trays 2b thereon in the direction of arrow 11 until the foremost filled tray 2b of such row advances into the range of and causes the initiator 16 to generate a signal. Such signal is transmitted to and effects energization of the electromagnet 13 which causes the pawl 14 to pivot clockwise, as viewed in FIG. 1, against the opposition of the spring 12 so that the foremost filled tray 2b of the row of trays 2b on the belts 9a of the conveyor 9 is arrested and does not interfere with transfer of the preceding filled tray 2b into or onto the holder 22 and/or with advancement of such holder in the directon of arrow 57 toward, to and beyond the intermediate position 22'.

The transporting apparatus 1 remains idle as long as the holder (note the holder 23 in FIG. 1) which is located at the vertex of elliptical path 24 contains a filled tray 2b, namely, as long as the photocell 21 transmits to the prime mover 17 a signal denoting that the holder at the vertex of the elliptical path 24 contains a filled tray. The signal from the photocell 21 actuates the aforementioned brake for the rotary part or parts of the prime mover 17 so that the latter is incapable of driving the moving parts of the transporting apparatus 1. The brake of or for the prime mover 17 is applied as long as the phototcell 21 transmits a signal simultaneously with the transmission of a signal from the initiator 18 which monitors the holder at the lowermost point of the elliptical path 24. However, when the filled tray 2b is removed from the holder (23 in FIG. 1) at the vertex of the elliptical path 24, the signal at the output of the photocell 21 disappears so that the prime mover 17 for the transporting apparatus 1 then receives a signal only from the initiator 18. Such signal results in activation or starting of the prime mover 17 because the brake is disengaged in response to disappearance of signal at the output of the photocell 21, whereby the transporting apparatus 1 begins to advance the freshly emptied holder 23 along the left-hand portion of the elliptical path 24 toward the separating portion 10 of the conveyor 9 while, at the same time, the filled holder 22 advances toward, through and beyond the intermediate position 22' and toward the vertex of the elliptical path 24 by moving along the right-hand portion of such path, as viewed in FIG. 1. At such time, the electromagnet 13 is deenergized so that the spring 12 is free to pivot the arresting pawl 14 in a counterclockwise direction, as viewed in FIG. 1, whereby the foremost filled tray 2b of the row of filled trays 2b on the conveyor 9 of FIG. 1 is free to advance under the action of the separating portion or unit 10 (belts 10a) so that it becomes separated from the next-following filled trays 2b and is ready to be accepted or engaged by the oncoming empty holder 23 which, in the meantime, advances toward the lowermost point of the elliptical path 24 by moving in the direction of arrow 57. The exact manner in which the electromagnet 13 is deenergized in response to starting of the prime mover 17 is not shown in the drawing because it forms no part of the invention. It suffices to say that the conveyor 9 cooperates with the transporting apparatus 1 in such a way that a filled tray 2b is ready for engagement by the oncoming empty holder 22 or 23 whenever such empty holder reaches the lowermost point of the elliptical path 24. The initiator 16 again transmits a signal to energize the electromagnet 13 and to pivot the arresting pawl 14 to the operative (intercepting) position of FIG. 1 as soon as the preceding tray 2b has reached the position in which it can be engaged by the oncoming empty holder 22 or 23.

The purpose of the initiator 19 is to arrest the prime mover 17 as soon as a filled holder reaches the removing station 4. At the same time, the empty holder is located at the lowermost point of the elliptical path 24 and is in the process of receiving or has already received the foremost (separated) filled tray 2b. Stoppage of the prime mover 17 in response to a signal from the initiator 19 is effected by the aforementioned brake which is applied as soon as the output of the initiator 19 transmits a signal denoting the presence of a filled holder at the vertex of the elliptical path 24.

In order to ensure that the filled tray 2b which arrives at the removing station 4 is held in optimum orientation for transfer into a gondola or for transfer onto another type of conveyor system, the transporting apparatus 1 further comprises novel and improved means for maintaining the orientation of holders 22 and 23 during travel along the elliptical path 24. This involves angular movements of the holders 22 and 23 through and beyond a plurality of intermediate positions which are indicated in FIG. 2. Such angular movements of the holders 22 and 23 during transport along the elliptical path 24 are further desirable and advantageous because they ensure that the elliptical path 24 can be very flat or narrow so that the transporting apparatus 1 occupies a minimum of space in the region between the discharge end of the conveyor 9 and the removing station 4. It will be readily appreciated that the elliptical path 24 must be established with a view to ensure that the descending empty holder does not interfere with upward movement of a filled holder, or vice versa. Moreover, movements of the holders 22 and 23 should be selected with a view to prevent sudden shocks to filled trays 2b during transfer from the conveyor 9 to the removing station 4 because such shocks could destroy the arrays of rod-shaped articles in filled trays.

Figure 3:
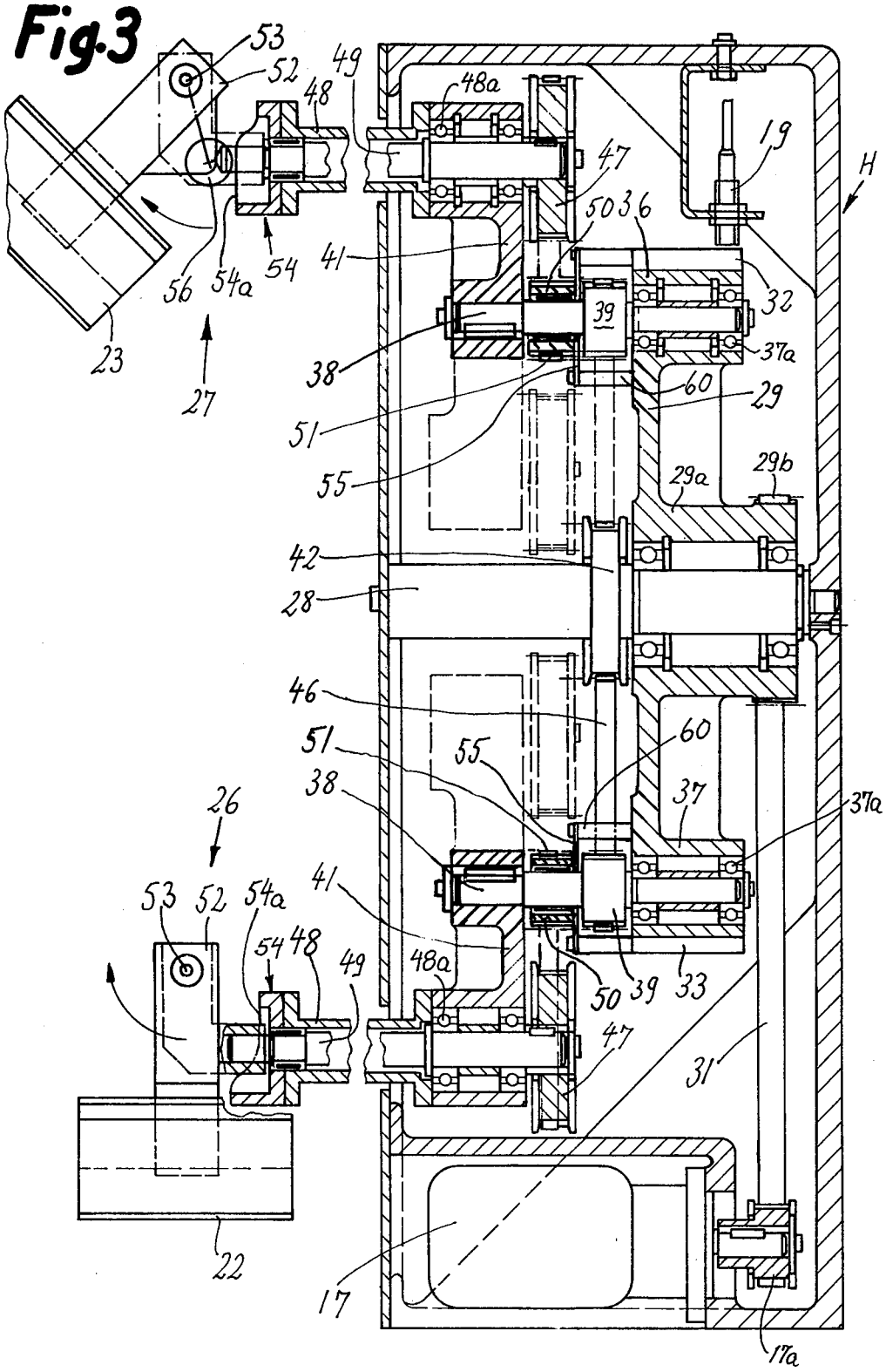
FIG. 3 is a vertical sectional view of the improved transporting apparatus, the apparatus being shown on a scale larger than that of FIG. 1 or 2.

As shown in FIG. 3, the transporting apparatus 1 comprises two conveyors 26 and 27 which respectively serve to transport the holders 22 and 23 for filled trays 2b. The means for moving the conveyors 26 and 27 comprises a first drive means which includes a lever 29 rotatable about the axis of a fixed shaft 28 mounted in a housing H. The lever 29 rotates about the axis of the shaft 28, and its end portions travel along a circular path 34 (see FIGS. 1 and 5). Such end portions are provided with cylindrical bearings 36, 37 for intermediate shafts 38 which are rotatable in antifriction bearings 37a. The lever 29 is driven by the prime mover 17 through the medium of an endless flexible element here shown as a toothed belt 31. To this end, the output element of the prime mover 17 carries a first toothed pulley or gear 17a and a portion of the hub 29a of the lever 29 constitutes a second toothed pulley or gear 29b. The belt 31 is trained over the pulleys 17a and 29b. The two arms of the lever 29 have outer end portions which carry projections or trips 32, 33 serving to actuate the initiator 19 of FIG. 1 so that the latter generates a signal whenever the holder 22 or 23 reaches the vertex of the elliptical path 24.

Figure 4:
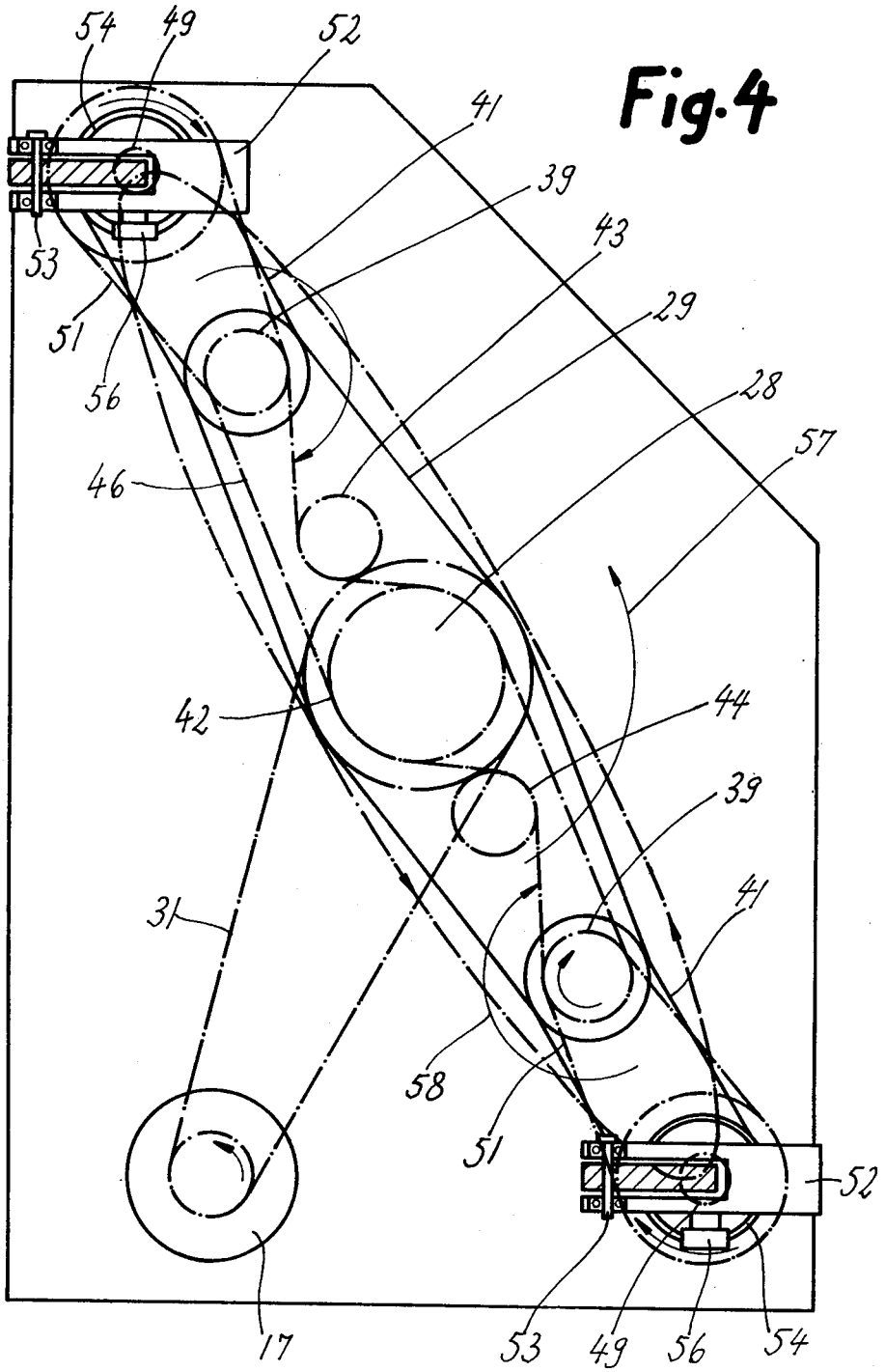
FIG. 4 is a side elevational view of the drive means in the transporting apparatus, with the housing omitted.

As mentioned before, the two arms of the lever 29 have outer end portions which constitute sleeves 36, 37 for the bearings 37a rotatably mounting the intermediate shafts 38. Each of the shafts 38 carries a pinion 39, and such pinions together constitute an intermediate drive means of the transporting apparatus 1. Each of the intermediate shafts 38 has a first end portion which is rotatable in the respective sleeve 36 or 37 and a second end portion which is keyed to a lever 41 constituting one of the two second drive means of the transporting apparatus 1. The hub 29a of the lever 29 is adjacent to a gear or toothed pulley 42 which meshes with the internal teeth of an endless internally toothed flexible element or belt 46. Such belt is further trained over the gears or pinions 39 on the two intermediate shafts 38. The pulley or gear 42 is coaxial and rigid with the fixed shaft 28. The transporting apparatus 1 further comprises two tensioning rolls 43 and 44 (see FIG. 4) which engage the endless internally toothed belt 46 in regions between the gear or pulley 42 and the pinions 39 on the respective intermediate shafts 38. The transmission ratio of the just described component of the drive means in the transporting apparatus 1 is selected in such a way that, when the lever 29 rotates about the axis of the fixed shaft 28 in a first direction (see the arrow 57 in FIG. 1), the pinions 38 roll along the internal surface of the internally toothed belt 46 so that the levers 41 of the second drive means are rotated about the axes of the respective shafts 38 counter to the direction of rotation of the lever 29 about the axis of the shaft 28 and at twice the angular velocity of the lever 29.

The transporting apparatus 1 further comprises a third drive means which serves to maintain the holders 22, 23 in parallelism with each other, namely, in parallelism with a horizontal plane so that the filled tray 2b which is supported by one of the holders 22, 23 is maintained in a vertical plane during transfer from the discharge end of the conveyor 9 to the receiving or removing station 4. As mentioned before, the second drive means includes the levers 41, and the holders 22, 23 are indirectly mounted on such levers. The third drive means of the transporting apparatus 1 ensures that the orientation of holders 22, 23 does not change during any stage of angular movement of the lever 29 about the axis of the fixed shaft 28 and/or during any stage of angular movement of levers 41 about the axes of the corresponding intermediate shafts 38. The third drive means of the transporting apparatus 1 comprises two disc-shaped gears 47 each secured to a shaft 49 rotatably mounted in the outer or free end portion of the respective lever 41. To this end, the outer end portions of the levers 41 have sleeve-like guide members 48 for pairs of antifriction bearings **48*a* rotatably mounting the corresponding shafts 49. The gears 47 have external teeth mating with internal teeth of endless toothed belts 51 which are further trained over drive pinions 50 constituting a further intermediate drive means of the transporting apparatus 1. Each pinion 50 is rotatably mounted on the intermediate shaft 38 for the respective lever 41 and each of these pinions is rigidly connected with the respective end portion of the lever 29 by means of a plate-like flange 55 and a retaining bolt or stud 60**.

The ratio of RPM of the drive pinions 50 to the associated gears 47 is two-to-one. Those end portions of the shafts 49 which extend beyond the respective sleeve-like guides 48 support carriers 52 for the holders 22 and 23. The arrangement is such that the holders 22 and 23 are turnable about the axes of shafts 53 mounted in the corresponding carriers 52. The shafts 53 are normal to the axes of the shafts 49, 38 and 28.

The transporting apparatus 1 further comprises means for rotating or turning the holders 22, 23 about the corresponding shafts 49 in order to move the holders at right angles to the plane of rotation of the conveyors 26 and 27. Such turning means for the holders 22 and 23 comprises cupped cams 54 which are rigid with the corresponding guides 48 so that their axes coincide with the axes of the respective shafts 49. The cam faces **54*a* at the left-hand axial ends of the cams 54, as viewed in FIG. 3, are tracked by roller followers 56 which are spaced apart from but can rotate the respective shafts 53 with the corresponding holders 22, 23 so that the configuration of the cam faces 54*a* determines the angular positions of holders 22, 23 relative to the axes of the associated shafts 53**.

The minor axis of the elliptical path 24 may constitute a very small or an extremely small fraction of the major axis of such path. For example, the minor axis may be less than one third of the major axis.

The apparatus 1 of FIGS. 1 to 5 exhibits the advantage that it must employ a single prime mover 17. This prime mover causes the lever 29 to rotate about the axis of the fixed shaft 28 whereby the lever 29 causes the levers 41 to rotate about the axes of the corresponding intermediate shafts 38. Such rotary movements of the levers 29 and 41 entail rotation of the shafts 49 of the third drive means. Also, the sleeves 48 which are rigid with the respective levers 41 cause the cams 54 to pivot the carriers 52 of the respective conveyors 26, 27 about the axes of the corresponding shafts 53.

Figure 5:
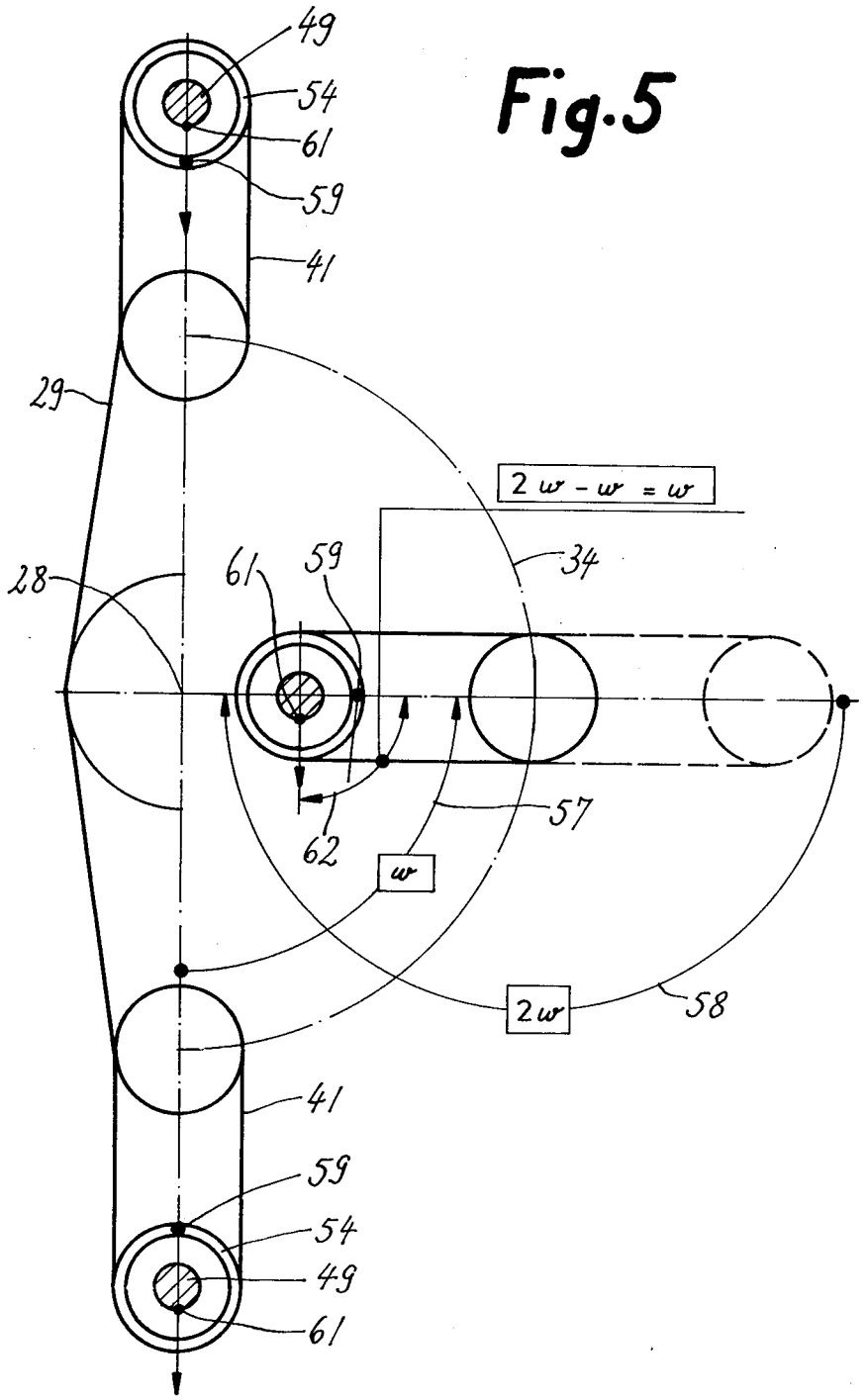
FIG. 5 is a schematic view of the paths of movement of certain component parts in the transporting apparatus of FIGS. 3 and 4.

The operation of the transporting apparatus 1 which is shown in FIGS. 1 to 5 is as follows:

When the control system of FIG. 1 transmits a signal which initiates the start of upward transport of a filled tray **2*b* with the corresponding holder (see the holder 22 of FIG. 1), the prime mover 17 drives the internally toothed belt 31 and thereby rotates the lever 29 in the direction of arrow 57 at an angular velocity omega. This causes the intermediate shafts 38, the pinions 39 and the levers 41 to orbit about the axis of the fixed shaft 28. It will be recalled that the two arms of the lever 29 rotate about the axis of the shaft 28 and that the intermediate shafts 38 are rotatably journalled in the bearings 36, 37 at the outer ends of such arms. The pinions 39 rotate counter to the direction of rotation of the lever 29 because they receive torque from the toothed belt 46 which shares the angular movement of the lever 29 (namely, of the first drive means of the transporting apparatus 1) about the axis of the fixed shaft 28. Consequently, the levers 41 of the second drive means, which are rigidly connected with the corresponding driver pinions 39, are driven at the angular velocity 2 omega and counter to the direction of rotation of the lever 29, i.e., in the directions indicated by the arrows 58 shown in FIGS. 4 and 5. FIG. 5 merely shows the path of rotary movement of one of the levers 41. This lever 41 forms part of the conveyor 26 in the transporting apparatus 1**.

For better understanding of angular movements of various driving elements of the drive means in the transporting apparatus 1 of FIGS. 1 to 5, FIG. 5 illustrates reference markers or indices 59 and 61 which are respectively applied to the cams 54 and shafts 49. In each of the three positions of the lever 41 which is shown in FIG. 5, the marker or index 61 on the corresponding shaft 49 indicates that the angular position of such shaft remains unchanged. This will be readily appreciated since the index or marker 61 is always located at the 6 o'clock position of the shaft 49, as viewed at the zero, at the three o'clock and at the six o'clock positions of the lever 41 shown in FIG. 5. Since the holder 22 is mounted on the respective shaft 49, the angular position or orientation of such holder also remains unchanged irrespective of the angular position of the associated lever 41. In the illustrated embodiment, the holder 22 remains horizontal or parallel to the floor so that the filled tray **2*b* which is supported thereby is maintained in an upright position, namely, in a position in which the axes of the rod-shaped articles stored in such tray are horizontal. This is accomplished in that the gear 47 on the shaft 49 of the conveyor 26 rolls along the internal surface of the corresponding internally toothed belt 51 which is further trained about the associated driver pinion 50. In view of the selected transmission ratio between the lever 41 and the lever 29, the shaft 49 rotates only at half the angular velocity of the lever 41 but in the same direction. This is indicated in FIG. 5 by the arrow 62. In FIG. 5, the equation omega=2 omega−omega denotes that the velocity omega of each shaft 49 equals the difference between the velocity (2 omega) of the cam 54 which is secured to the lever 41 and the velocity (omega) of the lever 29**.

Whenever the lever 29 of the first drive means completes a full revolution, the cam 54 also comprises a full revolution with reference to the axis of the shaft 49. This can be readily ascertained by looking at the position of the zero mark 59 on the cam 54 which is shown in FIG. 5. The configuration of the cam face **54*a* on the cam 54 is such that, while the cam 54 rotates with reference to the associated shaft 49, the roller follower 56 causes the holder 22 or 23 and the carrier 52** for such holder to turn about the axis of the corresponding shaft 53 in dependency on the position of the receiving or removing station 4 (see FIG. 2) as well as in dependency on the slope of the elliptical path portion between the removing station 4 and the discharge end of the conveyor 9 in such a way that the angular movement of the holder 22 or 23 about the axis of the respective shaft 53 ensures that the upwardly moving holder (which carries a filled tray 2*b*) does not collide with the downwardly moving empty holder in spite of narrowness of the elliptical path 24 for such holders. The elliptical path 24 is established in view of angular movement of the lever 41 counter to the direction of angular movement of the lever 29.

The manner in which a filled tray can be relieved of its contents is disclosed, for example, in commonly owned U.S. Pat. No. 4,278,385 granted July 14, 1981 to Bardenhagen et al.

Figure 6:
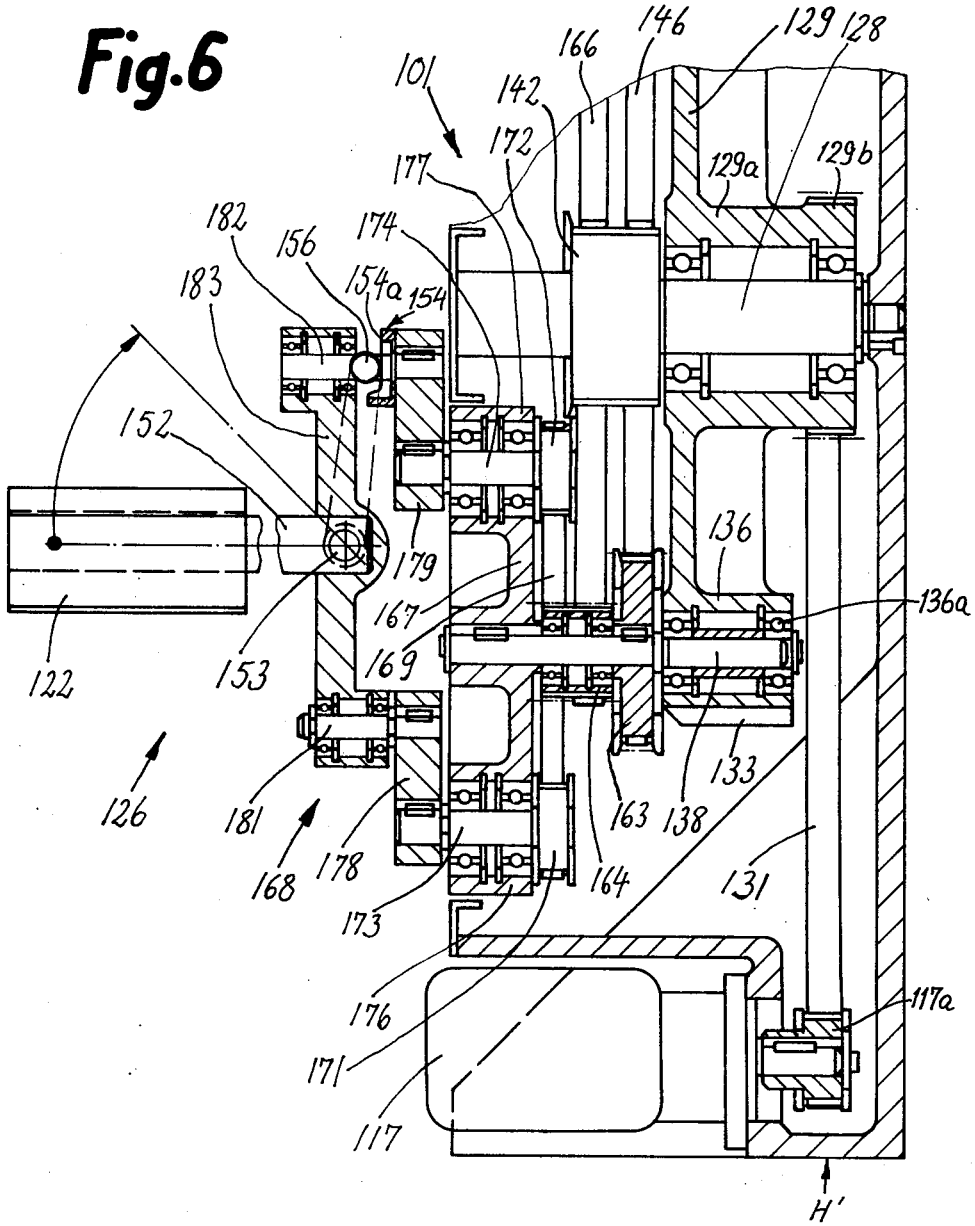
FIG. 6 is a fragmentary vertical sectional view of a modified transporting apparatus.
Figure 7:
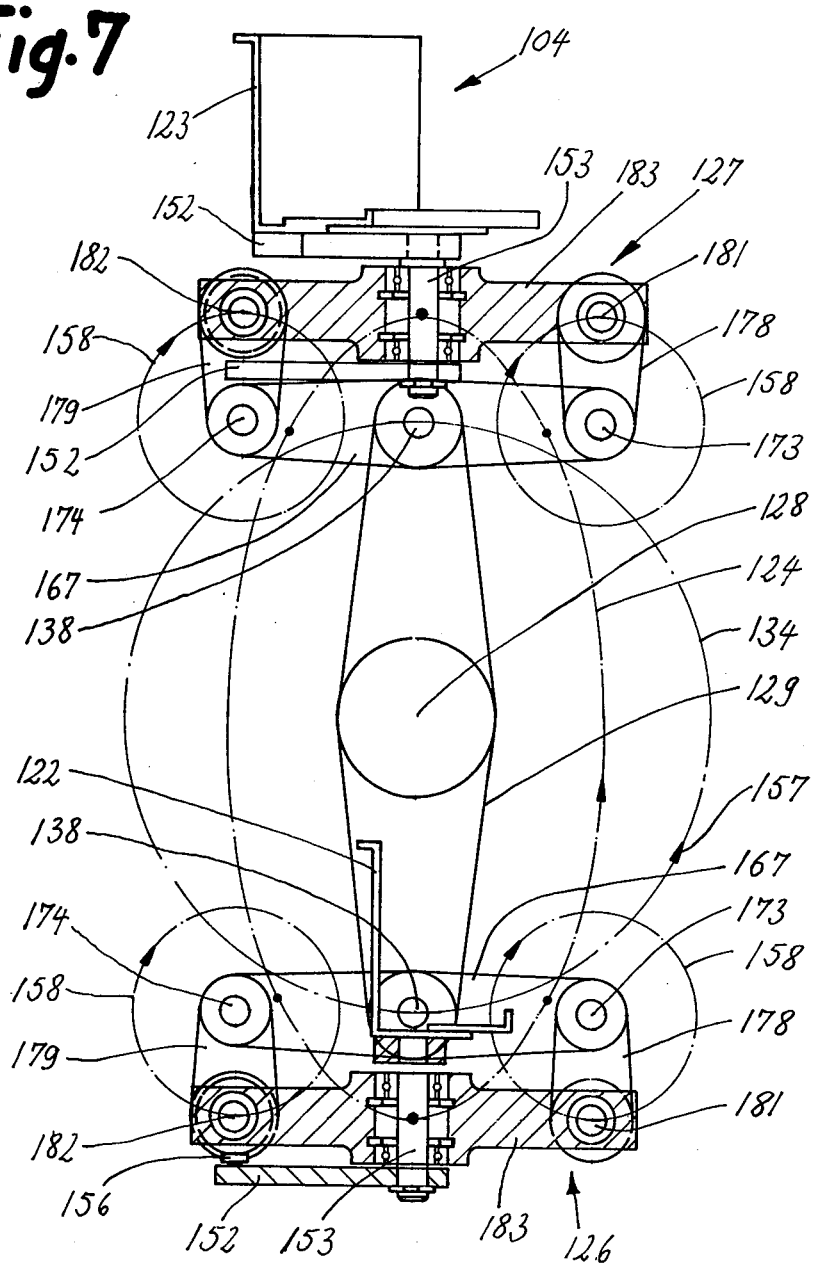
FIG. 7 is a front elevational view of the transporting apparatus which is shown in FIG. 6.

FIGS. 6 and 7 illustrate a portion of a modified transporting apparatus 101. All such component parts of the transporting apparatus 101 which are identical with or clearly analogous to the corresponding parts of the transporting apparatus 1 of FIGS. 1 to 5 are denoted by similar reference characters plus 100.

FIG. 6 merely shows one-half of the transporting apparatus 101, namely, the conveyor means 126 for the holder 122. The drive means of the transporting apparatus 101 again comprises a first driving unit having a lever 129 which is rotatable about the axis of a fixed shaft 128 mounted in a housing H'. The prime mover 117 for the lever 129 is or may constitute a rotary electromagnet which is supported by the housing H' and whose output element is keyed to a driver pinion or pulley 117*a* meshing with internal teeth of a toothed belt 131 which is further trained about a similar pulley or gear 129*b* on the hub 129*a* of the lever 129. The fixed shaft 128 is rigidly connected with a gear or toothed pulley 142. Each arm of the lever 129 is provided with a cylindrical bearing 136 (only one shown) for the corresponding intermediate shaft 138. One end portion of the intermediate shaft 138 is rotatably mounted in antifriction bearings 136*a* provided in the sleeve 136. Each intermediate shaft 138 is rigid with a gear or pulley 163 mating with the internal teeth of an endless toothed belt 146 trained over the gear 142 which is affixed to the stationary shaft 128. Each gear or pulley 163 is keyed to the corresponding intermediate shaft 138. A second internally toothed belt 166 is trained over the fixed gear or pulley 142 of the shaft 128 and is in mesh with the external teeth of a driver pinion 164 rotatably mounted on the correspondng intermediate shaft 138 adjacent to the respective gear or pulley 163. That end portion of each intermediate shaft 138 which extends to the left and beyond the corresponding driver pinion 164 (as seen in FIG. 6) is rigidly connected with a lever 167. Each lever 167 has two arms which are disposed diametrically opposite each other, and each of the levers 167 forms part of a discrete parallel crank transmission 168 which embodies the second and third drive means for the corresponding conveyor of the transporting apparatus 101. The transmission ratio between the lever 129 and the gear 163 on the intermediate shaft 138 is selected in such a way that their angular velocities are identical. In other words, the parallel crank transmission 168 is driven at the angular velocity of the lever 129 but in the opposite direction.

The dimensions of the driver pinions 164 on each of the intermediate shafts 138 are selected in such a way that each driver pinion rotates at twice the angular velocity of the respective gear or pulley 163. In other words, the angular velocity of each driver pinion 164 is twice the angular velocity of the lever 129 about the axis of the fixed shaft 128. The ratio of angular velocity of each driver pinion 164 to that of the associated lever 167 equals one-to-one. Moreover, the direction of rotation of each pinion 164 is the same as that of the associated lever 167, namely, counter to the direction of rotation of the lever 129 about the axis of the fixed shaft 128.

An internally toothed belt 169 meshes with the respective driver pinion 164 and transmits torque to a pair of gears 171, 172 respectively secured to shafts 173, 174 in the respective arms of the lever 167. To this end, the end portions of the arms of the lever 167 have sleeve-like bearings 176, 177 for pairs of antifriction bearings surrounding the corresponding shafts 173, 174. The left-hand end portions of the shafts 173, 174 (as viewed in FIG. 6) are keyed to crank arms 178, 179 which are respectively keyed to shafts 181, 182 rotatably mounted in the respective end portions of a coupling link 183. One of the crank arms 178, 179 (see the crank arm 179 in the upper left-hand portion of FIG. 6) is rigid with a cam 154 having a cam face 154*a* which is tracked by a roller follower 156 provided on the carrier 152 for the associated holder (see the holder 122 of FIG. 6). The carrier 152 is turnable about the axis of a shaft 153 which is mounted in the medium portion of the link 183 between the shafts 181 and 182.

The crank arms 178 and 179 constitute the second drive means of the transporting apparatus 101 and rotate at twice the angular velocity of and counter to the direction of rotation of the lever 129 which constitutes the first drive means of the apparatus 101. The crank arms 178 and 179 cause the holder 122 of FIG. 6 to travel along the elliptical path 124 of FIG. 7 while the lever 167 rotates counter to the direction of rotation of but at the angular velocity of the lever 129. The lever 167 and the link 183 constitute the third drive means of the transporting apparatus 101 and serve to maintain the holders 122, 123 of the transporting apparatus 101 in parallelism with each other, namely, in substantially horizontal positions so that a filled tray 2*b* which is supported by a holder (see the holder 123 in FIG. 7) is maintained in a substantially vertical plane in which the axes of the articles therein are substantially horizontal. The crank arms 178 and 179 are interposed between the corresponding lever 167 and the corresponding coupling link 183 of the apparatus shown in FIG. 6. The orientation of each holder (such as the holder 122 of FIG. 6) remains unchanged during upward or downward movement of the holder, i.e., irrespective of whether the holders 122, 123 move from the lower level toward the level of the receiving or removing station 104 or vice versa.

An important advantage of the improved transporting apparatus 1 or 101 is that it relieves the attendant or attendants of the task of lifting filled trays 2*b* from the lower level (see the conveyor 9 of FIG. 1) to the upper level (see the level of the removing or receiving station 4 or 104). Another important advantage of the improved transporting apparatus is that they can describe relatively narrow elliptical paths 24, 124 so that each of these transporting apparatus occupies a minimal amount of space between the discharge end of the conveyor 9 for filled trays 2*b* and the receiving or removing station 4 or 104. The aforediscussed mounting of the holders for angular movement about the respective shafts 53 or 153 renders it possible to cause such holders to bypass each other without any interference in spite of the narrowness of the elliptical path 24 or 124.

Since the first and second drive means of each of the two illustrated transporting apparatus are operatively connected with each other, the paths of movement of the two holders in each of the transporting apparatus are coordinated in such a way that there is no need for the provision of additional drive means which would achieve the desirable coordination of movement of the two holders. The provision of third drive means in each of the transporting apparatus ensures that the positions of rod-shaped articles in the filled trays **2*b* remain unchanged not only during transfer of trays 2*b* from the conveyor 9 onto the adjacent empty holder but also during transport of such holder from the lowermost point to the vertex of the respective elliptical path 24 or 124. Any shocks to the filled trays 2*b* or abrupt movements of the holders forming part of the transporting apparatus 1 or 101 could drastically change the distribution of articles in the filled trays. This is highly undesirable because such distribution should remain intact for proper gathering of predetermined numbers of rod-shaped articles into groups of ten, twenty, etc. articles each in the magazine or hopper of a packing or other processing or consuming machine which receives the contents of filled trays 2*b*. As explained above, each of the transporting apparatus comprises an intermediate drive which establishes an operative connection between the first and second drive means of the respective apparatus and further transmits motion to the associated third drive means. The cams 54 or 154 cooperate with the associated roller followers 56 or 156 in order to impart to the holders angular movements which are necessary to prevent interference on the part of one of the holders with movements of the other holder, or vice versa, while such holders travel along the respective reaches or portions of the corresponding narrow elliptical path 24 or 124**.

The construction of first drive means in the form of a lever (29 or 129) which is caused to rotate about the axis of a fixed shaft (28 or 128) contributes to compactness of the improved transporting apparatus and renders it possible to accommodate all drives of the respective apparatus in a common housing H or H'. The levers of the second drive means are pivotably mounted in or on the lever of the first drive means.

A further important advantage of the improved transporting apparatus is that their driving components perform pure rotary movements in such a way that filled trays **2*b* can be transported upwardly and empty holders can be transported downwardly along a relatively small endless elliptical path and without any abrupt stoppage or starting of the holders. The curves representing the acceleration and deceleration of holders on the respective conveyors of the transporting apparatus 1 or 101 are substantially sinusoidal curves, i.e., acceleration and deceleration of the holders are gradual so that the arrays of rod-shaped articles in the interior of filled trays 2*b* remain undisturbed during transfer onto empty holders or during transfer from filled holders to the receiving or removing station 4 or 104. This means that the transporting apparatus need not employ stops for abrupt termination of movement of the conveyors and/or shock absorbers for the holders 22, 23 or 122, 123. Still further, the improved transporting apparatus allow for accurate positioning of filled trays 2*b* in the associated or corresponding holders as well as at the station 4 or 104**.

Without further analysis, the foregoing will so fully reveal the gist of the present invention that others can by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for transporting trays or analogous containers for cigarettes, filter rod sections or other rod-shaped articles from a first station to a second station, comprising first drive means having a portion arranged to orbit along a first circular path, said first drive means comprising a first lever rotatable about a fixed axis and said portion of said first drive means being remote from said fixed axis and defining a second axis; means for rotating said first lever about said fixed axis at a first angular velocity; second drive means mounted on said portion of said first drive means and having a portion arranged to orbit along a second circular path superimposed upon said first circular path, said second drive means comprising a second lever rotatable about said second axis and said portion of said second drive means being remote from said second axis; means for rotating said second lever about said second axis at a second angular velocity which is twice said first angular velocity; and conveyor means for containers, said conveyor means being rotatably mounted in said portion of said second drive means and said first and second drive means defining an elliptical path for said conveyor means.

2. The apparatus of claim 1, wherein said conveyor means comprises holder means for removably supporting a container during travel of such holder means from the first to the second station.

3. The apparatus of claim 2, wherein said second station is located at a level above said first station.

4. The apparatus of claim 2, wherein said holder means defines an endless path having a vertex at said second station.

5. The apparatus of claim 1, wherein said means for rotating said first lever comprises means for orbiting said portion of said first drive means in a first direction along said first circular path and said means for rotating said second lever comprises means for orbiting said portion of said second drive means along said second circular path and in a second direction counter to said first direction.

6. The apparatus of claim 1, further comprising means for transmitting motion from one of said drive means to the other of said drive means.

7. The apparatus of claim 1, further comprising third drive means interposed between said second drive means and said conveyor means and arranged to prevent changes in orientation of said conveyor means during orbital movements of said portions of said first and second drive means along the respective circular paths.

8. The apparatus of claim 7, further comprising intermediate drive means operatively connected with said first and second drive means and arranged to transmit motion to said third drive means.

9. The apparatus of claim 7, wherein said first and second drive means are disposed in a predetermined plane and further comprising means for rotating said conveyor means with reference to said third drive means about an axis which is substantially transverse to said plane.

10. The apparatus of claim 9, wherein said means for rotating said conveyor means is superimposed upon said second and third drive means.

11. The apparatus of claim 1, wherein said means for rotating said second lever comprises a fixed first gear whose axis coincides with said first axis, a shaft rotatably mounted in said portion of said first drive means and defining said second axis, a second gear fixed to said shaft, and an endless flexible element trained over said gears to rotate said second gear in response to rotation of said first lever about said fixed axis, said second lever being arranged to share the rotary movements of said shaft.

12. The apparatus of claim 11, wherein said flexible element comprises an internally toothed belt.

13. The apparatus of claim 1, wherein the minor axis of said elliptical path is a small fraction of the major axis of such elliptical path.

14. Apparatus for transporting trays or analogous containers for cigarettes, filter rod sections or other rod-shaped articles from a first station to a second station, comprising first drive means having a portion arranged to orbit along a first circular path, said first drive means comprising a first lever rotatable about a fixed axis and said portion of said first drive means being remote from said fixed axis and defining a second axis; second drive means mounted on said portion of said first drive means and having a portion arranged to orbit along a second circular path superimposed upon said first circular path, said second drive means comprising a second lever rotatable about said second axis and said portion of said second drive means being remote from said second axis; and conveyor means for containers, said conveyor means being rotatably mounted in said portion of said second drive means and comprising a shaft journalled in said second lever and defining a third axis parallel to said second axis, holder means supported by said shaft and means for rotating said shaft including a first gear connected with said shaft, a second gear connected with said first drive means and having an axis coinciding with said second axis, and an endless flexible element trained over said gears.

15. The apparatus of claim 14, further comprising a second shaft journalled in said portion of said first drive means and defining said second axis, said second lever being non-rotatably mounted on and said second gear being rotatable with reference to said second shaft.

16. The apparatus of claim 15, wherein the ratio of RPM of said second gear to said first gear and said first mentioned shaft is two-to-one.

17. The apparatus of claim 16, wherein the direction of rotation of said second lever about said second axis is identical with the direction of rotation of said first gear, said second lever being arranged to rotate about said second axis at twice the angular velocity of said first gear about the axis of said first mentioned shaft.

18. The apparatus of claim 14, wherein said flexible element comprises an internally toothed belt.

19. The apparatus of claim 14, further comprising a cam rigid with said second lever and coaxial with and rotatable relative to said shaft, a carrier forming part of conveyor means and connecting said shaft with said holder means, and follower means tracking said cam and arranged to pivot said holder means about a fourth axis substantially normal to said third axis in response to rotation of said second lever about said second axis.

20. The apparatus of claim 19, wherein said portion of said second drive means comprises a bearing sleeve coaxially surrounding said shaft, said cam means comprising a face cam rigid with said sleeve.

21. Apparatus for transporting trays or analogous containers for cigarettes, filter rod sections or other rod-shaped articles from a first station to a second station, comprising first drive means having a portion arranged to orbit along a first circular path, said first drive means comprising a lever which is rotatable about a fixed axis and said portion of said first drive means being remote from said fixed axis and defining a second axis parallel to said fixed axis; a transmission including second drive means mounted on said portion of said first drive means and having a portion arranged to orbit along a second circular path superimposed upon said first circular path, said transmission comprising a pair of crank arms constituting said second drive means and third drive means including a second lever rotatable about said second axis and rotatably mounting said crank arms, said third drive means further comprising a coupling link articulately connected with said crank arms; means for rotating said transmission about said second axis; and conveyor means for containers, said conveyor means being supported by said link.

22. The apparatus of claim 21, wherein said means for rotating said transmission derives motion from said first drive means.

23. The apparatus of claim 22, wherein said means for rotating said transmission comprises a fixed first gear whose axis coincides with said fixed axis, a shaft rigid with said second lever, rotatably mounted in said first mentioned lever and having an axis coinciding with said second axis, a second gear rigid with said shaft, and an endless flexible element trained over said gears to rotate said second gear and said second lever about said second axis in response to rotation of said first mentioned lever about said fixed axis.

24. The apparatus of claim 23, wherein said transmission further comprises two additional shafts rotatably mounted in said second lever and each rigid with a different one of said crank arms, the axes of said additional shafts being parallel to said second axis and said transmission further comprising means for driving said additional shafts including a third gear rotatably mounted on said first mentioned shaft, additional gears each affixed to a different one of said additional shafts, and an endless flexible element trained over said third gear and said additional gears to rotate said additional gears in response to rotation of said second lever about said second axis.

25. The apparatus of claim 24, wherein the ratio of RPM of said lever of said first drive means about said fixed axis to the RPM of said second gear about said second axis is one-to-one.

26. The apparatus of claim 24, further comprising means for rotating said third gear in response to rotation of the lever of said first drive means about said fixed axis.

27. The apparatus of claim 26, wherein the means for rotating said third gear comprises an endless flexible element trained over said first and third gears.

28. The apparatus of claim 24, wherein the ratio of RPM of each of said additional shafts about the respective additional axis to the RPM of the lever of said first drive means about said fixed axis is two-to-one.

29. The apparatus of claim 28, wherein the lever of said first drive means is arranged to rotate in a predetermined direction and said crank arms are arranged to rotate about the respective additional axes counter to said predetermined direction.

30. The apparatus of claim 24, wherein at least one of said flexible elements includes an internally toothed belt.

31. The apparatus of claim 24, wherein said conveyor means comprises means for rotating said holder means about a further axis normal to said second axis.

32. The apparatus of claim 31, wherein the means for rotating said holder means comprises a cam coaxial with one of said additional shafts, a carrier mounting said holder means, and follower means tracking said cam and arranged to pivot said carrier about said further axis.

33. The apparatus of claim 32, wherein said cam is rigid with the crank arm on said one additional shaft and said further axis is defined by said coupling link.

* * * * *